US006354019B1

(12) United States Patent
Becker

(10) Patent No.: US 6,354,019 B1
(45) Date of Patent: Mar. 12, 2002

(54) METHOD FOR DRYING PAPER

(75) Inventor: Ernest Becker, Berglen (DE)

(73) Assignee: Becker Preservotec GmbH, Winnenden (DE)

( * ) Notice: Subject to any disclaimer, the term of this patent is extended or adjusted under 35 U.S.C. 154(b) by 0 days.

(21) Appl. No.: 09/424,362

(22) PCT Filed: May 25, 1998

(86) PCT No.: PCT/EP98/03069

§ 371 Date: Feb. 7, 2000

§ 102(e) Date: Feb. 7, 2000

(87) PCT Pub. No.: WO98/53153

PCT Pub. Date: Nov. 26, 1998

(30) Foreign Application Priority Data

May 23, 1997 (DE) ..... 197 21 707

(51) Int. Cl.[7] ..... F26B 5/04
(52) U.S. Cl. ..... 34/403
(58) Field of Search ..... 34/403, 404, 406, 34/408, 412

(56) References Cited

U.S. PATENT DOCUMENTS 3,409,389 A * 11/1968 Bjork ..... 34/403 X
4,809,596 A * 3/1989 Akutsu et al. ..... 34/403 X
5,038,494 A 8/1991 Lundquist et al.
5,120,600 A * 6/1992 Eggersdorfer et al.
5,282,320 A 2/1994 Wedinger et al.
5,852,880 A * 12/1998 Harrison

FOREIGN PATENT DOCUMENTS

CA 452588 A * 11/1948 ..... 34/403
SU 305995 A * 6/1971 ..... 34/403
WO WO 91/04787 4/1991

* cited by examiner

*Primary Examiner*—Harold Joyce
(74) *Attorney, Agent, or Firm*—Crowell & Moring LLP

(57) ABSTRACT

In a process for drying paper, in particular whole books but also other absorbent and in particular organic materials present in particular in layered or laminated form, to achieve residual moisture contents of 1% and below in the shortest possible time and without other disadvantageous effects on the paper or the books, in particular as a first treatment step in the mass deacidification of paper, the paper is heated by being acted upon with warm air and dried by being acted upon with reduced pressure. The operation of acting upon the paper with reduced pressure is effected periodically.

21 Claims, 1 Drawing Sheet

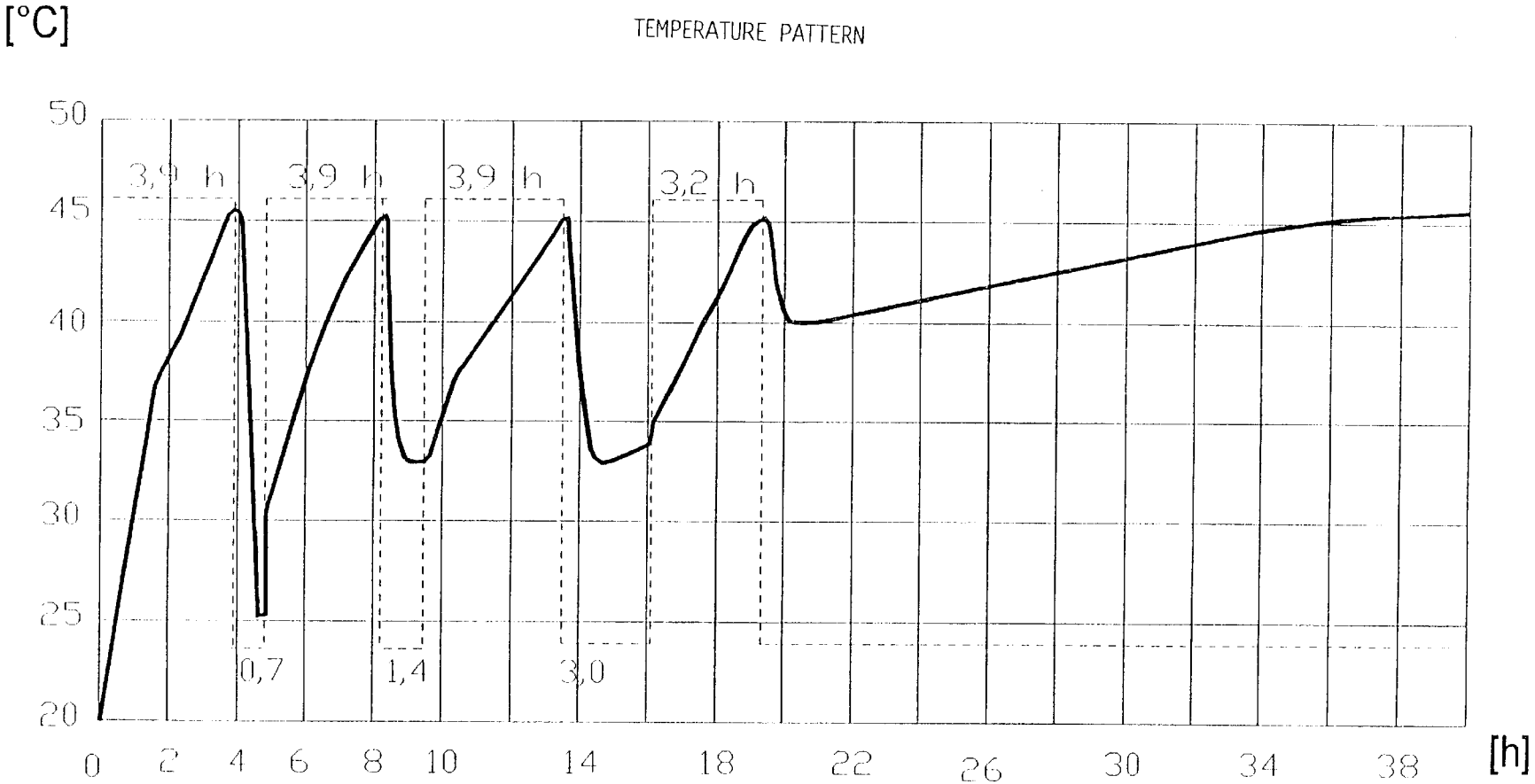
TEMPERATURE PATTERN
[°C]
50
45
40
35
30
25
20
[h]
0
2
4
6
8
10
14
18
22
26
30
34
38
3,9 h
3,9 h
3,9 h
3,2 h
0,7
1,4
3,0

METHOD FOR DRYING PAPER

BACKGROUND AND SUMMARY OF THE INVENTION

The invention concerns a process for drying paper, in particular whole books. This drying process however can also be applied to other absorbent and in particular organic materials which occur in particular in layered or laminated form.

From time to time, paper and in particular paper in the form of books has to be dried relatively quickly and down to very low moisture contents of in part below 1% by weight—% of water.

That is necessary when books which have been stored in an excessively wet condition or which have become wet due to water damage are to be rescued, in which case the drying operation into a range of somewhat below 10% moisture content is implemented by means of conventional methods, that is to say by producing a flow of warm air therearound, storing the books in well-heated and well-ventilated drying chambers, and so forth.

Further drying to about 1% residual moisture content and below is necessary however in particular in regard to what is known as mass deacidification of paper as a first treatment step or as a terminating drying operation (post-drying), in which the books as a whole, that is to say without previously being separated into individual sheets or leaves, which is an expensive and complicated operation, are chemically deacidified in order to eliminate the acids which ultimately destroy the books, such acids being mostly contained in the paper size but also in the inks and printing dyes.

In those comparatively advantageous processes for preserving in particular historical stocks of books, at a low level of financial expenditure, the operation of drying the books to a residual moisture content of below 1%, which is necessary before implementing the chemical treatment, represents the bottleneck in the process, in terms of time and capacity, as such a drying operation can only be implemented by means of heating and subjecting the books to a reduced pressure, and can thus be carried out in so-called autoclaves, that is to say containers which can be hermetically closed shut and which can be acted upon by a reduced pressure.

In order in that procedure to achieve the maximum quantitative through-put of paper, that is to say for example books, the books of which a conventional size of autoclave will accommodate for example 100 kg are initially dried by microwave drying in the autoclave and the moisture which is so liberated is removed by the subsequent application of vacuum. This cycle which is only implemented once takes up a relatively small amount of time as the drying operation using microwaves only requires between about 2 and 3 hours.

The disadvantage of this process however is that even very small metal constituents in the book resulted in the book burning in the area around those metal constituents. Since even the relatively small amounts of heavy metal in historic inks or in book-printing inks and dyes were found to be sufficient as metal constituents in that sense, with the passage of time, microwave drying is now practically no longer used.

Other drying methods such as for example drying using infra-red radiation also raised other problems, for example a variation in color at least in the regions of the books which are near the surface, but also an insufficiency of action in terms of depth, with the consequence that the regions in the middle of a book could not be adequately dried.

Therefore, drying by means of warm or hot air is preferred, as this appears to be the only procedure which does not seem to involve discernible disadvantages, irrespective of the age of the book and therewith the nature of the paper, the composition of the printing dye or inks and so forth.

In that respect the treatment using hot or warm air has hitherto always been implemented in such a way that the books are disposed in an autoclave whose walls are heatable. By the walls of the autoclave being heated, the air in the interior of the autoclave is heated and the paper disposed therein is thus also heated, by way of the air. In part the increase in temperature of the paper was also effected directly by way of radiant heat which was caused to act directly on the books, from the heating elements of the wall of the autoclave.

During the heating operation the interior of the autoclave and therefore also the books therein is permanently subjected to the action of reduced pressure, and otherwise the autoclave is closed. Therefore in particular no fresh air was introduced into the autoclave during the heating and suction removal procedure.

That mode of operation prevented freshly entering air from having a higher moisture content than the residual moisture content that it was endeavoured to achieve in the paper.

The disadvantage here however is that between 1 and 2 days are required to dry a batch of between 80 and 100 kg of books of initially between 6 and 8% by weight of water to below 1% by weight of water.

Therefore the object of the present invention is to provide a process for drying paper, even in compact form such as for example whole books, in which residual moisture contents of 1% and below can be achieved in the minimum possible time and without other disadvantageous effects on the paper or the books.

That object is attained in that the treatment with reduced pressure is effected not permanently but periodically. In addition, new, heated, dry air is fed to the paper at least between the phases of the reduced-pressure treatment, with the moisture content of that new air being below 1% by weight of water.

In that situation heating is effected by using warm air and drying is effected by means of the application of vacuum in a plurality of cycles in succession, preferably in between four and six cycles.

The efficiency of this process is very good by virtue of the fact that the moment in time from which further heating or further drying becomes inefficient can be very clearly established.

First of all, for the heating phases, it is necessary to establish a maximum temperature which should be as high as possible in order to cause as much moisture as possible to diffuse out of the paper. Generally that procedure is implemented using a temperature of between 40 and 50° C. as no residual adverse effects on the paper or the printing on the paper are still to be feared at that temperature, such as for example discoloration phenomena, excessive brittleness and in that case breakage in the subsequent treatment of the paper and so forth, irrespective of the epoch from which the paper to be treated originates.

The duration of the heating phases is determined by the consideration that the desired final temperature of for example 45° must be achieved in the interior of the amount of paper disposed in the autoclave, that is to say for example in the interior of the books which are stored in the center thereof. In that respect the dried warm air which acts on the paper should be not substantially hotter but only about a maximum of 10° C., in particular only a maximum of 5° C., hotter, in order not to cause an excessive rise in temperature of the outside regions, before the final temperature in the interior of the batch of paper is reached.

After the final temperature has been reached even in the center of the batch of paper, the feed of warm air is interrupted and the autoclave is closed except for the reduced-pressure connection, by way of which the paper is subjected to the action of compressed air.

Depending on the power of the vacuum pump connected thereto, only a few minutes are required when dealing for example with 100 kg of paper, in order to achieve the desired reduced pressure of less than 10 mbar and preferably less than 1 mbar.

However the holding time of that reduced pressure is a crucial aspect in terms of drying the paper:

When the reduced pressure is applied to the autoclave, the temperature of for example 45° C. which is initially present in the interior of the autoclave begins to fall rapidly towards ambient temperature outside the autoclave, as in fact a further supply of heat in the form of preheated air no longer takes place.

Very suddenly however, that is to say after a holding time of at least half an hour, within between two and three minutes and preferably even within less than a minute, that temperature drop slows down drastically or comes to a stop, or is even reversed to become a rise in temperature.

The cause of the stagnation in the fall in temperature is that, below a given temperature (in dependence on the degree of drying which has already been achieved), no further evaporation worth mentioning occurs and thus the evaporation enthalpy becomes equal to zero.

After the suction flow is broken off, the temperature within the accumulation of paper which had been previously heated to about 45° C. is equalized and is set to a temperature level which self-evidently is higher than the temperature in the approximate vacuum surrounding the accumulation of paper and prevailing within the autoclave. As that temperature of the vacuum was previously measured at the temperature sensor disposed in the accumulation of paper, an increase in temperature is displayed there.

As soon as this effect of slowing down the fall in temperature or temperature stagnation or even the rise in temperature occurs, the invention provides that application of the vacuum is broken off and the paper is again heated by acting thereon with pre-dried warm air. In that phase of operation the autoclave can be closed and warm air is continuously urged into the closed space, which however results in only a low level of air exchange. Preferably the autoclave is at least slightly opened at another location in order to cause the pre-dried warm air to flow through the interior of the autoclave, in which respect flow rates of between 0.1 m/s and 2.0 m/s, in particular between 0.5 m/s and 1.0 m/s, should prevail.

That procedure avoids causing vacuum to act for an unnecessarily long period of time and/or causing warm air to act for an unnecessarily long period of time, while permitting a high quantitative through-put in the drying operation, combined with a level of energy consumption which is at an optimum low figure.

Accordingly, with between 6 and 8% initial moisture, it is possible to achieve a residual moisture content of below 1% in a maximum of one and a half days, generally in between 12 and 24 hours, for which purpose approximately five and in some cases even only four cycles consisting of heating and drying have to be effected.

In that respect, with an accumulation of paper of for example 100 kg, the first heating phase lasts between about 2 and 3 hours and the duration of those heating phases is slightly reduced to between 1 and 2 hours in regard to the last heating phase.

In contrast the evacuation phases become longer from one cycle to another and in particular they double from one cycle to another.

With the specified amount of paper of 100 kg, the first evacuation phase lasts for between 0.7 and 0.8 hours and the evacuation phase after the fourth heating phase lasts about 6 hours. After the fifth heating phase evacuation is then generally effected over a period of between five and ten hours, whereby approximately between the last 0.5 and 0.7% by weight of water, with respect to the mass of paper, is achieved, before reaching the final content of less than 1.0% by weight of water.

A renewed heating operation within that long last evacuation phase is in that respect no longer meaningful, in consideration of the following tendency:

The reversal in trend which is to be observed during the vacuum treatment, that is to say a reduction in the rate of the fall in temperature or even stagnation and a reversal into the opposite direction, admittedly takes place in terms of time after an increasingly long period of vacuum treatment, but in regard to temperature, at temperatures which are ever increasing, although during the heating phases the same final temperature is always attained in the interior of the accumulation of paper, for example 45° C.

If, after the for example fourth heating phase, upon subsequent evacuation, the reduction in the rate of drop in temperature occurs after an evacuation time of about one hour, in that case a temperature of about 40° C. still generally obtains in the interior of the accumulation of paper.

However, as soon as the temperature at which the reversal in trend of the drop in temperature occurs is only 5° C. or less below the final temperature of the preceding heating phase, renewed heating is then no longer meaningful, and then the paper is only still subjected to the action of vacuum until the final state of less than 1% by weight is reached.

BRIEF DESCRIPTION OF THE DRAWINGS

An embodiment according to the invention will now be described in greater detail by way of example with reference to FIG. 1. FIG. 1 shows the temperature pattern in the interior of a relatively compact accumulation of paper, that is to say for example between the pages of a book which is arranged in the interior of a stack or an accumulation of books.

DETAILED DESCRIPTION OF THE INVENTION

That temperature is plotted against time, thus showing the time duration and the qualitative configuration of the heating phases and the evacuation phases.

This experiment which was conducted with a collection of paper of a weight of between 80 and 100 kg shows that, starting from 20° C. ambient temperature and with a slight increased pressure, about four hours were required in order for the desired final temperature of 45° C. to be attained at the sensor at the interior of the accumulation of paper by blowing air into same or blowing air through same, with the temperature thereof being about . . . ° C. and containing less than 1.0% by weight of water. The subsequently applied vacuum causes the temperature to fall within 0.6 hour to 25° C., in which case temperature stagnation occurs almost abruptly.

As soon as this is the case, the reduced-pressure source is cut off or separated from the autoclave and the paper in the interior of the autoclave is heated again by means of the above-described warm air until once again a final temperature of 45° C. is attained at the temperature sensor in the interior of the accumulation of paper, with a period of just four hours being again required for that purpose.

After that is achieved and the reduced-pressure source is again connected to the autoclave, the desired reduced pressure of up to 1 mbar is initially built up within the autoclave very much more rapidly, as is shown by the very much more pointed configuration of the peak in this second cycle.

The fall in temperature is initially just as rapid, but below about 35° C. it begins to become slower and already reverses at a temperature value of about 32° C. to become a rise in temperature, although 1.4 hours are required for that, from the application of vacuum.

The subsequent heating operation from about 32° C. to once again 45° C. takes place markedly more slowly. For this temperature difference which is still only about 10° C. 3.8 hours are required, when being subjected to the action of warm air in the same manner.

In the subsequent treatment with vacuum, almost the same configuration as after the second heating phase is to be observed, and also the subsequent heating operation with which approximately the same temperature difference as a cycle previously must be implemented also requires approximately the same time.

After this fourth heating phase the initially sharp drop in temperature again reverses after about one hour to become a rise in temperature, but this already occurs at a temperature which is still 40° C.

Then, reduced pressure is applied in an evacuation phase of prolonged duration on a continuous basis, but at least more than two hours, in some cases up to 16 hours, until the desired residual moisture level is reached.

What is claimed is:

1. A process for drying an organic material, comprising:

heating the material with warm air having a moisture content below 1% by weight of water; and periodically drying the material with a reduced pressure.

2. A process as set forth in claim 1, wherein treatment of the material with warm air occurs periodically and alternately with the treatment by means of reduced pressure.

3. A process as set forth in claim 1, wherein the treatment with warm air is effected by transporting air that has already been previously heated to the material and passing it over the material.

4. A process as set forth in claim 1, wherein when the material is acted upon with warm air a flow rate of the air in the proximity of the material is between 0.1 m/s and 2.0 m/s.

5. A process as set forth in claim 4, wherein the flow rate is between 0.5 m/s and 1.0 m/s.

6. A process as set forth in claim 1, wherein the treatment with warm air and the subsequent treatment with reduced pressure is effected in between four and six successive cycles in order to dry between six and eight % by weight of moisture to a maximum of 1% by weight of moisture.

7. A process as set forth in claim 1, wherein in the treatment by reduced pressure, the reduced pressure is less than 10 mbar.

8. A process as set forth in claim 7, wherein the reduced pressure is less than 1 mbar.

9. A process as set forth in claim 1, wherein treatment of the material is effected batch-wise.

10. A process as set forth in claim 9, wherein said treatment is effected in an autoclave.

11. A process as set forth in claim 1, wherein the material is acted upon with warm air to a final temperature for the material of between 40° C. and 50° C.

12. A process as set forth in claim 11, wherein the final temperature is about 45° C.

13. A process as set forth in claim 1, wherein when treating an amount of 100 kg of material the first heating phase lasts between about 2 and 3 hours and the duration of the heating phases gradually decreases to between about 1 and 2 hours in the last phase.

14. A process as set forth in claim 1, wherein the action of reduced pressure on the material after the respective heating phases is effected until the temperature of the material which falls sharply during the treatment with reduced pressure very greatly slows down.

15. A process as set forth in claim 14, wherein the fall in temperature even reverses to become a rise in temperature.

16. A process as set forth in claim 1, wherein in the treatment of 100 kg of material the first evacuation phase lasts between 0.7 and 0.8 hour.

17. A process as set forth in claim 1, wherein the duration of the individual evacuation phases approximately doubles from one cycle to another.

18. A process as set forth in claim 17, wherein the duration of the evacuation phase is about 6 hours after a fourth and last heating period.

19. A process as set forth in claim 1, wherein the organic material is paper.

20. A process as set forth in claim 1, wherein the organic material is a book.

21. A process as set forth in claim 11, wherein the organic material is a book and the final temperature is in an interior of the book.

* * * * *